US007800006B2

(12) United States Patent
Mishima

(10) Patent No.: US 7,800,006 B2
(45) Date of Patent: Sep. 21, 2010

(54) PUSH SWITCH

(75) Inventor: Norikazu Mishima, Osaka (JP)

(73) Assignee: Hosiden Corporation, Yao-shi, Osaka (JP)

( * ) Notice: Subject to any disclaimer, the term of this patent is extended or adjusted under 35 U.S.C. 154(b) by 600 days.

(21) Appl. No.: 11/802,489

(22) Filed: May 23, 2007

(65) Prior Publication Data

US 2007/0278078 A1 Dec. 6, 2007

(30) Foreign Application Priority Data

May 30, 2006 (JP) ..... 2006-149339

(51) Int. Cl.
*H01H 3/12* (2006.01)

(52) U.S. Cl. ..... 200/341; 200/345

(58) Field of Classification Search ..... 200/341–345, 200/524

See application file for complete search history.

(56) References Cited

U.S. PATENT DOCUMENTS 5,584,384 A * 12/1996 Mizuno et al. ..... 200/524

FOREIGN PATENT DOCUMENTS

| | | | |
|---|---|---|---|
| JP | 1109149 | U | 7/1989 |
| JP | 223 0621 | A | 9/1990 |
| JP | 804 5379 | A | 2/1996 |
| JP | 81 90833 | A | 7/1996 |
| JP | 907 3836 | A | 3/1997 |
| JP | 2004-273199 | | 9/2004 |

* cited by examiner

*Primary Examiner*—Renee Luebke
*Assistant Examiner*—Lisa Klaus
(74) *Attorney, Agent, or Firm*—Bacon & Thomas, PLLC

(57) ABSTRACT

A push switch, including a keytop, a keytop returning coil spring, which urges the keytop upwardly, a slider which is press-operated via the keytop, a slider returning coil spring, which urges the slider upwardly, and switch contacts which are contacted with and separated from each other in accordance with the operating position of the slider. The slider returning coil spring is placed at a position deviated from the axis of the keytop. A push switch which is small in size, produces less tilting or rattling even when a large keytop is attached, and which generates an excellent operation feeling is provided.

7 Claims, 8 Drawing Sheets

PUSH SWITCH

BACKGROUND OF THE INVENTION

1. Field of the Invention

The present invention relates to a push switch which is to be used in various electronic apparatuses, or an operating unit of an automobile or the like.

2. Description of the Prior Art

Basically, the structure of a push switch is configured by an operating portion and a switching portion. The operating portion is a portion with which a human hand is to be contacted, and has a function of transmitting an operation force to the switching portion. The switching portion is to be connected to a wiring board, and has a function of contacting and separating switch contacts. In such a push switch, in order to enhance the density on the board or the like, the switching portion is requested to be miniaturized. On the other hand, a part which is situated at the uppermost position of the operating portion, and which can be seen by and contacted with the human, i.e., a keytop is often requested to be enlarged (as compared to the switching portion) in view of operability and design. Many large keytops have a structure which is divided into a portion constituting an operating face, and a portion that supporting it from the lower side. Furthermore, the illumination type in which the operation state of an operated apparatus, or the like is illuminated and displayed on a keytop is often used. In the illumination type, the portion constituting an operating face is transparent and colorless or translucent, and an engraved plate or a color plate can be interposed between the portion and the supporting portion.

A push switch to which a large keytop is attached, and which is used for illuminating the interior of an automobile is configured in the following manner. A switching portion is formed on the side of the lower face of a cover in which a boss portion is disposed in the middle. A slider which is upward protruded from the switching portion is inserted into the boss portion in a vertically movable manner. A shaft portion which hangs from the middle of the lower face of the keytop is inserted into the boss portion in a vertically movable manner. A keytop returning coil spring is placed in the periphery of the boss portion and between the lower face of the keytop and the upper face of the cover, so that the contact/separation state of switch contacts is switched over by a pushing operation, but the keytop is always returned to the state attained before the operation.

Such a conventional push switch is known in, for example, Japanese Patent Application Laying-Open No. 2004-273199. In the push switch, the axis of a keytop functions as the center of the switch, and a cover, a switching portion, and a keytop returning coil spring are placed coaxially with the keytop. In the switching portion, a slider is housed in a vertically movable manner in a box-like body in which the open upper face is closed by the cover, a slider returning coil spring is placed between the lower face of the slider and the inner bottom face of the body, a slider locking mechanism of the heart-shaped cam type is formed between one side face of the slider and the body, and switch contacts of the sliding contact type are formed between another side face of the slider and the body. Also the body, the slider, and the slider returning coil spring of the switching portion are placed coaxially with the keytop.

SUMMARY OF THE INVENTION

In the conventional push switch, the slider returning coil spring is placed coaxially with the keytop and the keytop returning coil spring. In order to avoid interference of the slider returning coil spring with the slider locking mechanism or the switch contacts, the size of the slider must be increased, and hence there is a problem in that the switching portion is hardly miniaturized. The center of the keytop is supported only by a single shaft. When the size of the keytop is increased, tilting or rattling occurs, thereby further producing a problem in operation feeling. Moreover, this problem is made more prominent by miniaturization of the switching portion.

The invention is to provide a push switch in which a keytop, a keytop returning coil spring which upward urges the keytop, a slider which is press-operated via the keytop, a slider returning coil spring which upward urges the slider, and switch contacts which are contacted with and separated from each other in accordance with the operating position of the slider are disposed, wherein the slider returning coil spring is placed at a position deviated from the axis of the keytop. The push switch is small in size, less produces tilting or rattling even when a large keytop is attached, and generates an excellent operation feeling.

DETAILED DESCRIPTION OF THE PREFERRED EMBODIMENT

Figure 1:
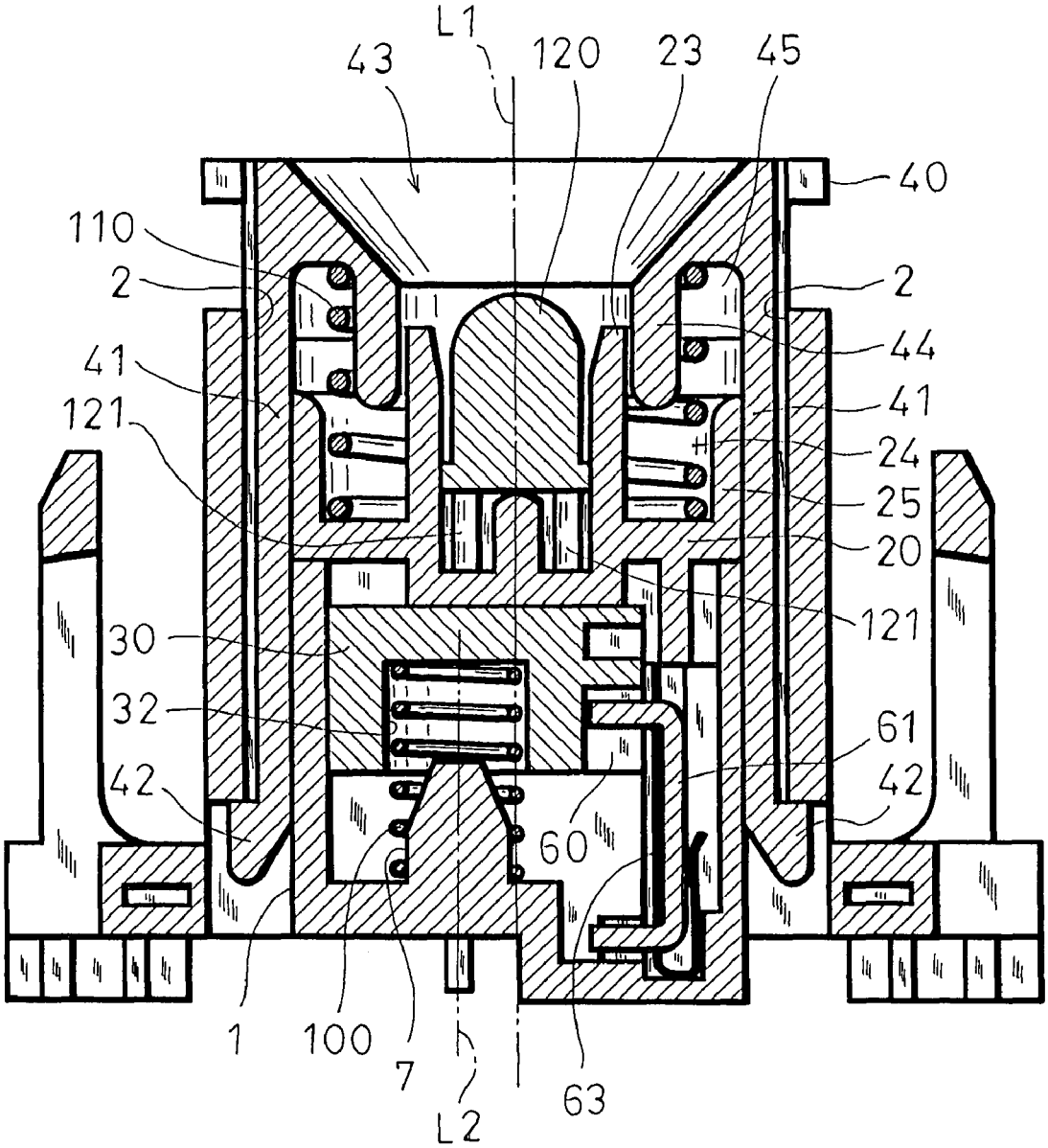
FIG. 1 is a section view showing a push switch of an embodiment of the invention, taken along a lateral section line.

Hereinafter, a push switch of an embodiment of the invention will be described in detail with reference to FIGS. 1 to 8.

The push switch is configured in the following manner. A large keytop 40 of the illumination type which has a substantially square plate-like external shape, and which is made of an insulating resin supports from the lower side a cap (not shown) which constitutes an operating face, which is made of an insulating resin, and in which the whole or a part is transparent and colorless or translucent. In some cases, an engraved plate or a color plate is interposed between the cap and the keytop. Plate-like legs 41 hang from two opposed outer edge portions of the keytop, respectively. Between the legs 41, a body 1 which has a rectangular box-like shape, in which the upper face is opened, and which is made of an insulating resin is raised from the lowermost portions of the push switch coaxially with the axis L1 of the keytop 40. Guide holes 2 into which the legs 41 are fitted in a vertically slidable manner are disposed in two outer faces of the body opposed to the legs 41, respectively so that the keytop 40 is held in a vertically movable manner, and an outer side portion of the keytop 40 is guided by the outer side of the body 1.

Engaging claws 42 which are caused to butt against the lower ends of the walls of the guide holes 2 by a returning operation (upward motion) of the keytop 40 are disposed in tip end portions of the legs 41 which are protruded to the under sides of the guide holes 2.

The body 1 is formed by insert molding. Plural (five) terminals 50 made of a conductive metal for connecting to the outside are disposed integrally with a bottom portion. One-end portions of the terminals 50 are protruded in one direction from the bottom portion of the body 1 in a laterally arranged manner. The open upper face of the body 1 is closed by a cover 20 which has a substantially square plate-like shape, and which is made of an insulating resin. In the cover 20, engaging holes 22 into which engaging claws 3 protruded from the outer face of the body 1 are fitted are disposed in four legs 21 hanging from vicinities of the four edges of the cover on the outside of the outer face of the body 1, respectively. The cover is put on the open upper face of the body 1.

A circular double wall structure configured by an inner wall 23, a gap 24, and an outer wall 25 which is shorter than the inner wall 23 is raised coaxially with the axis L1 of the keytop 40 from the upper face of the cover 20. An LED 120 serving as an illumination light source for the keytop 40 is housed inside the inner wall 23 of the double wall structure, and placed coaxially with the axis L1 of the keytop 40 in a middle portion of the upper face of the cover 20.

Two anode and cathode lead wires 121 drawn out from the body of the LED 120 are drawn out to the outside of the double wall structure via a cutaway 26 of the inner wall 23, the gap 24, and a cutaway 27 of the outer wall 25, and passed through two lead grooves 4 formed in the outer face of the body 1, respectively. End portions of the lead wires are inserted into through holes of corresponding ones (the outermost two terminals 50) of the terminals 50, and connected thereto by soldering on the outer bottom face of the body 1. The LED 120 is small in size, and does not incorporate a current-limiting resistor. Therefore, the voltage is lowered by an external resistor 130. The external resistor 130 is incorporated in an intermediate portion of one of the terminals 50 which is connected to the anode lead wire 121.

A large circular through hole 43 which is coaxial with the axis L1 of the keytop 40, and the diameter of which is substantially equal to the outer diameter of the outer wall 25 of the double wall structure is disposed in a middle portion of the keytop 40. The middle portion of the keytop 40 is illuminated through the through hole 43 with the LED 120 placed immediately below the hole. The keytop 40 is fitted onto the outside of the inner wall 23 of the double wall structure in a vertically slidable manner through the through hole 43 so that the middle portion of the keytop 40 is guided by the outer face of the inner wall 23.

A tapered portion 46 in which the diameter is gradually expanded as further advancing toward the upper side is formed in an upper portion of the keytop 40. A cylindrical pressing portion 44 hangs from the peripheral edge of the through hole 43 and coaxially with the axis L1 of the keytop 40. The pressing portion 44 is fitted onto the outside of the inner wall 23 of the double wall structure in a vertically slidable manner so that the middle portion of the keytop 40 is guided by the outer face of the inner wall 23. The inner wall 23 of the double wall structure, and the pressing portion 44 form a light blocking plate which surrounds the range from the peripheral side of the LED 120 to the illumination face of the LED to prevent light from leaking.

Between the top faces (the lower face of the keytop 40) of gaps 45 between the pressing portion 44 of the keytop 40 and the legs 41, and the bottom face (the upper face of the cover 20) of the gap 24 of the double wall structure of the cover 20, a keytop returning coil spring 110 which is made of a metal is placed in a preloaded state coaxially with the axis L1 of the keytop 40. The keytop 40 is upward urged by the keytop returning coil spring 110, the engaging claws 42 are caused to butt against the lower ends of the walls of the guide holes 2, and the keytop 40 is engaged with the body 1 to be held to a returning position shown in FIGS. 1 and 2.

In the body 1, a slider 30 which is made of an insulating resin, and a slider returning coil spring 100 which is made of a metal, which is smaller in diameter than the keytop returning coil spring 110, and which exerts a smaller spring force are housed, and a slider locking mechanism of the heart-shaped cam type and switch contacts of the sliding contact type are formed.

A pin attaching portion 5 for a hook pin 61 made of a metal is formed on the inner side of one of two adjacent inner faces of the body 1. The hook pin has a substantially U-like shape, and cooperates with a heart-shaped cam groove 60 which is disposed in one side face of the slider 30, to form the slider locking mechanism of the heart-shaped cam type. A board attaching portion 6 for a substantially rectangular flat plate-like wiring board (micro PCB) 81 serving as stationary contacts is formed on the inner side of the other inner face. The stationary contacts cooperate with movable contacts 80 which are disposed on another side face of the slider 30, and in which cantilever plate springs made of a conductive metal are used, to form the switch contacts of the sliding contact type. The slider 30 is fitted to a region in the body 1 excluding the pin attaching portion 5 and the board attaching portion 6, in a state where lateral and longitudinal movements are restricted and only a vertical movement is allowed, so that the body 1 guides the slider 30 at a position which is deviated from the axis L1 of the keytop 40 in the diagonal direction of the other two adjacent inner face corner portions of the body 1, inside the body.

In the cover 20, plural (two) through holes 28 are disposed at symmetric positions of the bottom face of the gap 24 of the double wall structure. From the upper face of the slider 30, plural (two) pressure receiving portions 31 are raised so as to be protruded from the interior of the body 1 into the gap 24 of the double wall structure through the through holes 28 so that end portions of the pressure receiving portions 31 of the slider 30 butt from the lower side against an end portion of the pressing portion 44 of the keytop 40 in the gap 24 of the double wall structure.

A positioning recess 32 into which an upper portion of the slider returning coil spring 100 is fitted from the lower side is disposed in the lower face of the slider 30. From the inner bottom face of the body 1 opposed to the lower face of the slider 30, a guide pin 7 onto which a lower portion of the slider returning coil spring 100 is fitted is protruded at a position opposed to the recess 32. The slider returning coil spring 100 is placed in a preloaded state between the top face of the recess 32 of the slider 30 and the inner bottom face of the body 1. The slider 30 is upward urged by the slider returning coil spring 100, the upper face of the slider 30 is caused to butt against the lower face of the cover 20, the slider 30 is held in the body 1 to a returning position shown in FIGS. 1 and 2, and the end portions of the pressure receiving portions 31 of the slider 30 held to the returning position butt from the lower side against the end portion of the pressing portion 44 of the keytop 40 held to the returning position as shown in FIG. 2.

In the slider returning coil spring 100, the axis L2 is placed at a position which is deviated from the axis L1 of the keytop 40 in the diagonal direction of the other two adjacent inner face corner portions of the body 1, and at a position which is deviated from the axis of the slider 30 that vertically moves at the position which are deviated from the axis L1 of the keytop 40 in the diagonal direction of the other two adjacent inner face corner portions of the body 1, in the diagonal direction of the other two adjacent inner face corner portions of the body 1. According to the configuration, the distances required between the slider returning coil spring 100, and the slider locking mechanism and switch contacts on the side portion of the slider 30 can be ensured by the slider 30 which is smaller as compared with the case where the slider 30 and the slider returning coil spring 100 are placed coaxially with the axis L1 of the keytop 40.

The heart-shaped cam groove 60 is disposed in one side face of the slider 30 opposed to the pin attaching portion 5 of the slider 30, the upper end of the hook pin 61 is contacted substantially perpendicularly with the cam groove 60, and the lower end of the hook pin 61 is supported by the pin attaching portion 5 in the body 1 via a metal-made support plate 62 so as to move in accordance with the vertical movement of the slider 30, whereby the slider locking mechanism of the heart-shaped cam type is formed.

The movable contacts 80 in which the cantilever plate springs made of a conductive metal are used are disposed on one side face of the slider 30 opposed to the board attaching portion 6, a wiring pattern printed surface of the wiring board 81 is contacted with the free end portions of the movable contacts 80, and the wiring board 81 is fitted to the board attaching portion 6 in the body 1 so as to slide in accordance with the vertical movement of the slider 30, whereby the switch contacts of the sliding contact type are formed.

The three movable contacts 80 upward extend in parallel from one end edge of a laterally elongated basal portion 82 which has a substantially U-like section shape, and which is upward opened. The basal portion 82 is fitted from the lower side onto a contact holding portion 33 which is protruded from the lower face of the slider 30, and the three contacts are juxtaposed on one side face opposed to the board attaching portion 6. By contrast, in the wiring board 81, the three stationary contacts are formed on the wiring pattern printed surface in correspondence to the three movable contacts 80. One of the stationary contacts is a middle stationary contact which is always contacted with the middle movable contact 80 to be electrically connected thereto. Another one stationary contact is a first switchover stationary contact which, when the slider 30 is returned, is contacted with the movable contact 80 on one side to be electrically connected to the middle stationary contact through the movable contact 80. The further stationary contact is a second switchover stationary contact which, when the slider 30 is pressed down, is contacted with the movable contact 80 on the other side to be electrically connected to the middle stationary contact through the movable contact 80. Three pin-like terminals 83 which are connected respectively to the stationary contacts through the wiring pattern are protruded from the wiring board 81. By fitting to the board attaching portion 6, end portions of the terminals 83 are inserted into through holes of the remaining three terminals 50 on the inner side to be connected thereto by soldering on the outer bottom face of the body 1.

The thus configured push switch is attached to an apparatus while the upper face (the upper face of the cap attached onto the keytop) of the keytop 40 is protruded slightly upward from a through hole of a case of the apparatus, and the terminals 50 are connected by soldering to a wiring pattern of a wiring board constituting an electronic circuit of the apparatus.

Next, a method of assembling the push switch will be described.

First, the support plate 62 which holds the hook pin 61 is inserted into the pin attaching portion 5 in the body 1 from the open upper face of the body 1, and the wiring board 81 is inserted into the board attaching portion 6 in the body 1. At this time, the end portions of the terminals 83 of the board attaching portion 6 are inserted into the through holes of the corresponding terminals 50 of the body 1, the lower portion of the slider returning coil spring 100 is fitted onto the guide pin 7 which is protruded from the inner bottom face of the body 1, the slider returning coil spring 100 is placed on the inner bottom face of the body 1, and the hook pin 61, the wiring board 81, and the slider returning coil spring 100 are incorporated into the body 1.

Next, a lower portion of the slider 30 to which the movable contacts 80 are attached is inserted into the body 1 from the open upper face of the body 1, and the upper end of the hook pin 61 is fitted from the lower side into a lower portion of the cam groove 60 of the slider 30. The upper portion of the slider returning coil spring 100 of the free length is fitted from the lower side into the recess 32 of the lower face of the slider 30, and the slider 30 is placed on the slider returning coil spring 100.

Next, while the pressure receiving portions 31 of the slider 30 are inserted from the lower side into the through holes 28 of the cover 20, the cover 20 is put on the slider 30. The slider 30 is pressed down by the lower face of the cover 20. While the slider returning coil spring 100 is compressed between the top face of the recess 32 of the slider 30 and the inner bottom face of the body 1, the slider 30 is pressed into the body 1. The cover 20 is put on the open upper face of the body 1. The engaging claws 3 of the body 1 are fitted into the engaging holes 22 of the legs 21 of the cover 20, whereby the cover 20 is fixed to the open upper face of the body 1.

Then, the LED 120 is fitted into the inside of the inner wall 23 of the double wall structure which is raised from the upper face of the cover 20. At this time, end portions of the lead wires 121 of the LED 120 are inserted into the through holes of the corresponding terminals 50 of the body 1. Thereafter, a lower portion of the keytop returning coil spring 110 is fitted into the gap 24 of the double wall structure, and the keytop returning coil spring 110 is placed on the bottom face of the gap 24 of the double wall structure.

Finally, the legs 41 of the keytop 40 are inserted from the upper side into the guide holes 2 of the body 1, and the keytop 40 is held on the cover 20. While the keytop returning coil spring 110 is compressed between the top faces of the gaps 45 and the bottom face of the gap 24 of the double wall structure of the cover 20, the legs 41 are inserted into the guide holes 2 until the engaging claws 42 in the tip end portions of the legs 41 are protruded to the undersides of the guide holes 2, so that the keytop 40 is attached to the upper side of the cover 20, thereby completing the push switch.

A process of soldering the lead wires 121 of the LED 120 and the terminals 83 of the board attaching portion 6 with the terminals 50 of the body 1 is manually performed after the push switch is assembled.

Next, the operation of the push switch will be described.

Figure 2:
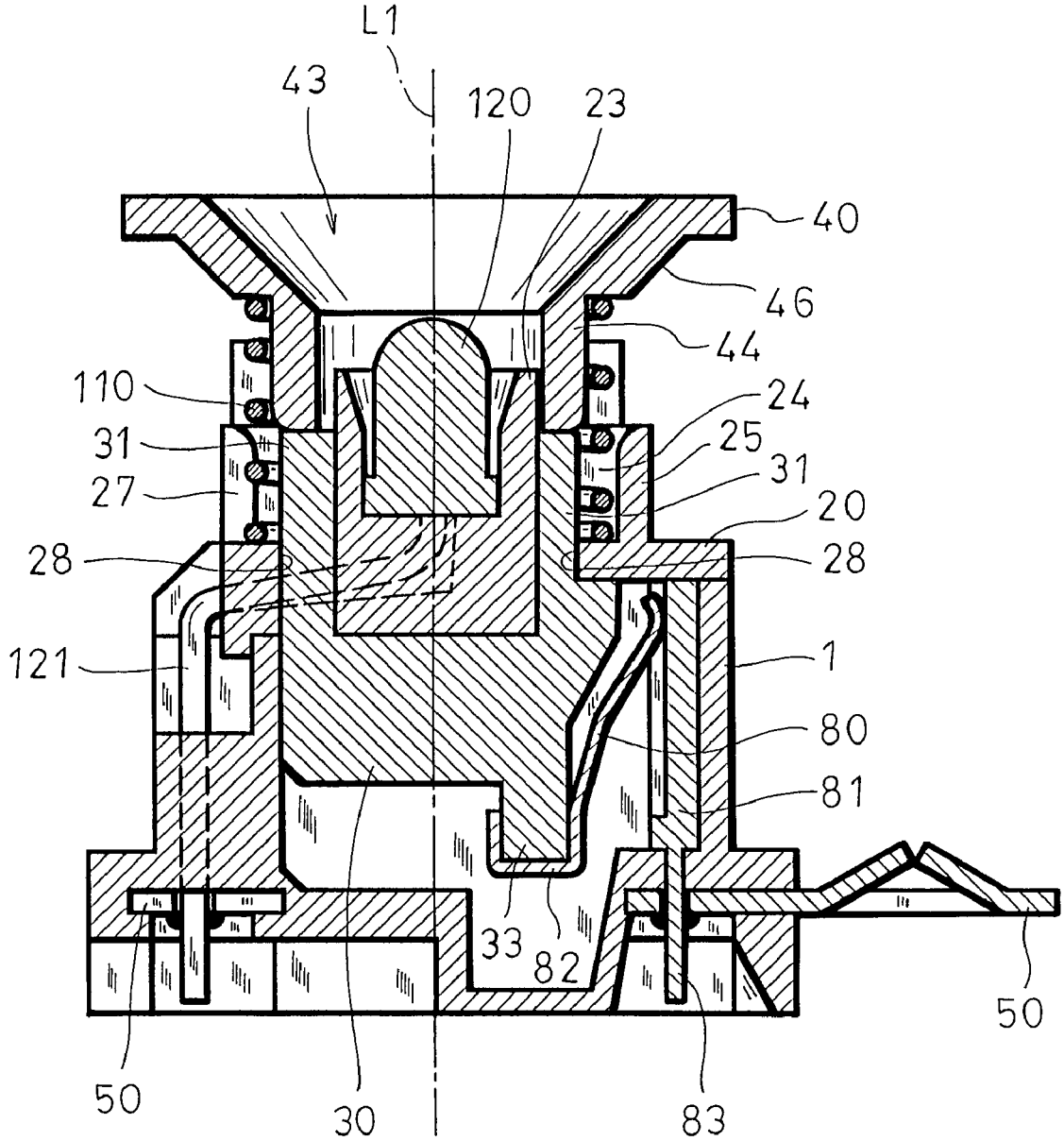
FIG. 2 is a section view showing the push switch taken along a longitudinal section line.
Figure 3:
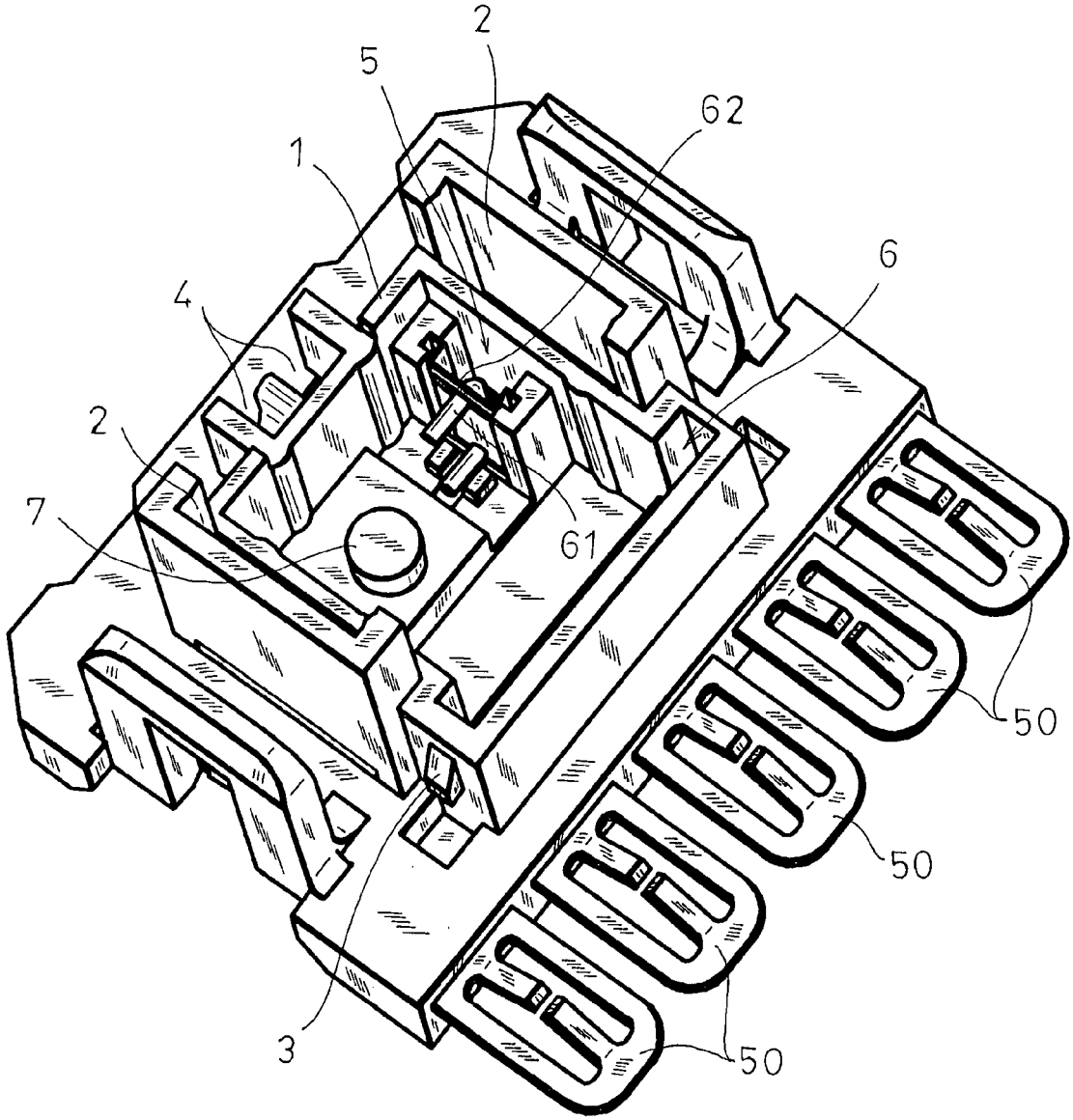
FIG. 3 is a perspective view of a body disposed in the push switch.
Figure 4:
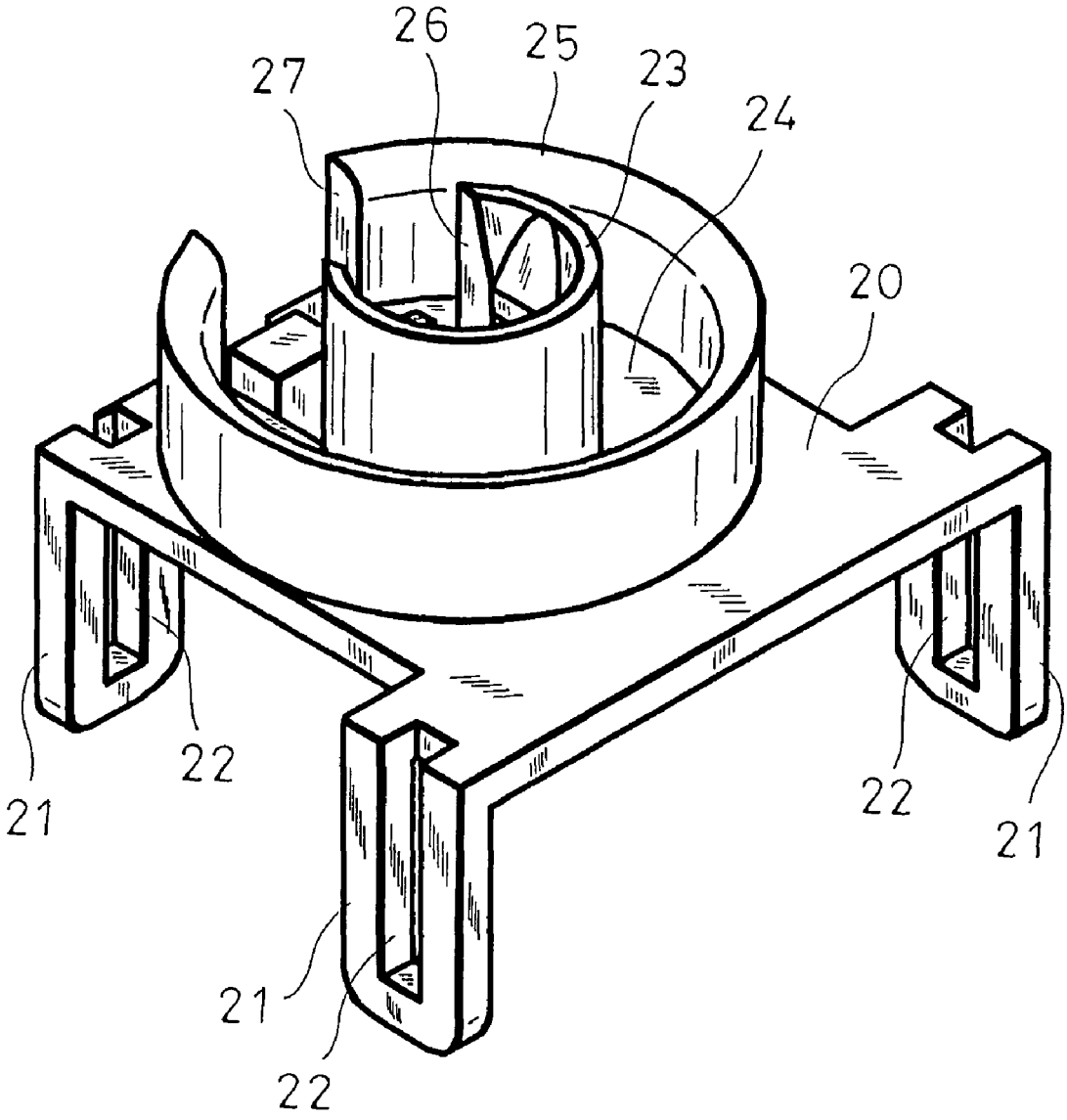
FIG. 4 is a perspective view of a cover disposed in the push switch.
Figure 5:
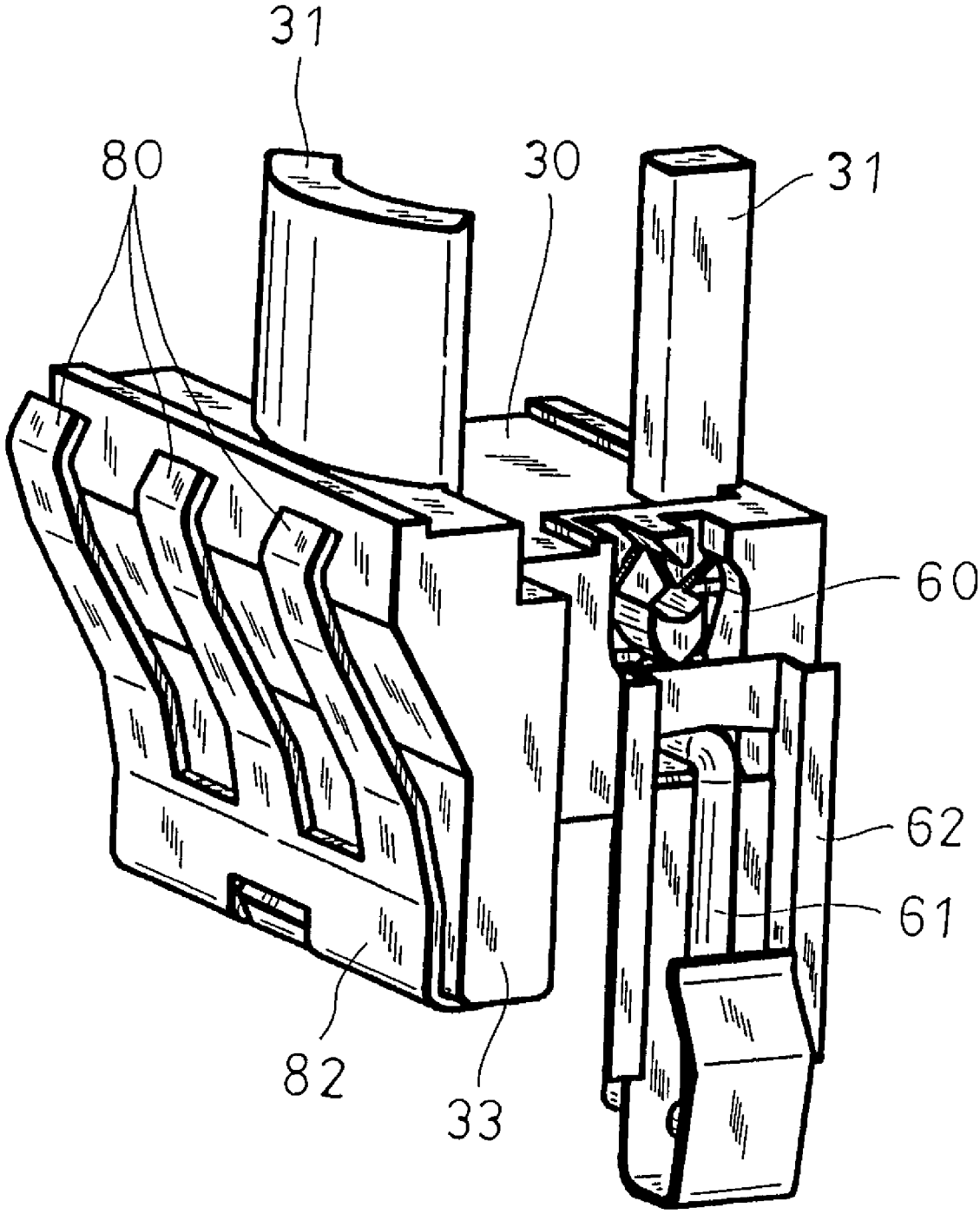
FIG. 5 is a perspective view of a slider disposed in the push switch.
Figure 6:
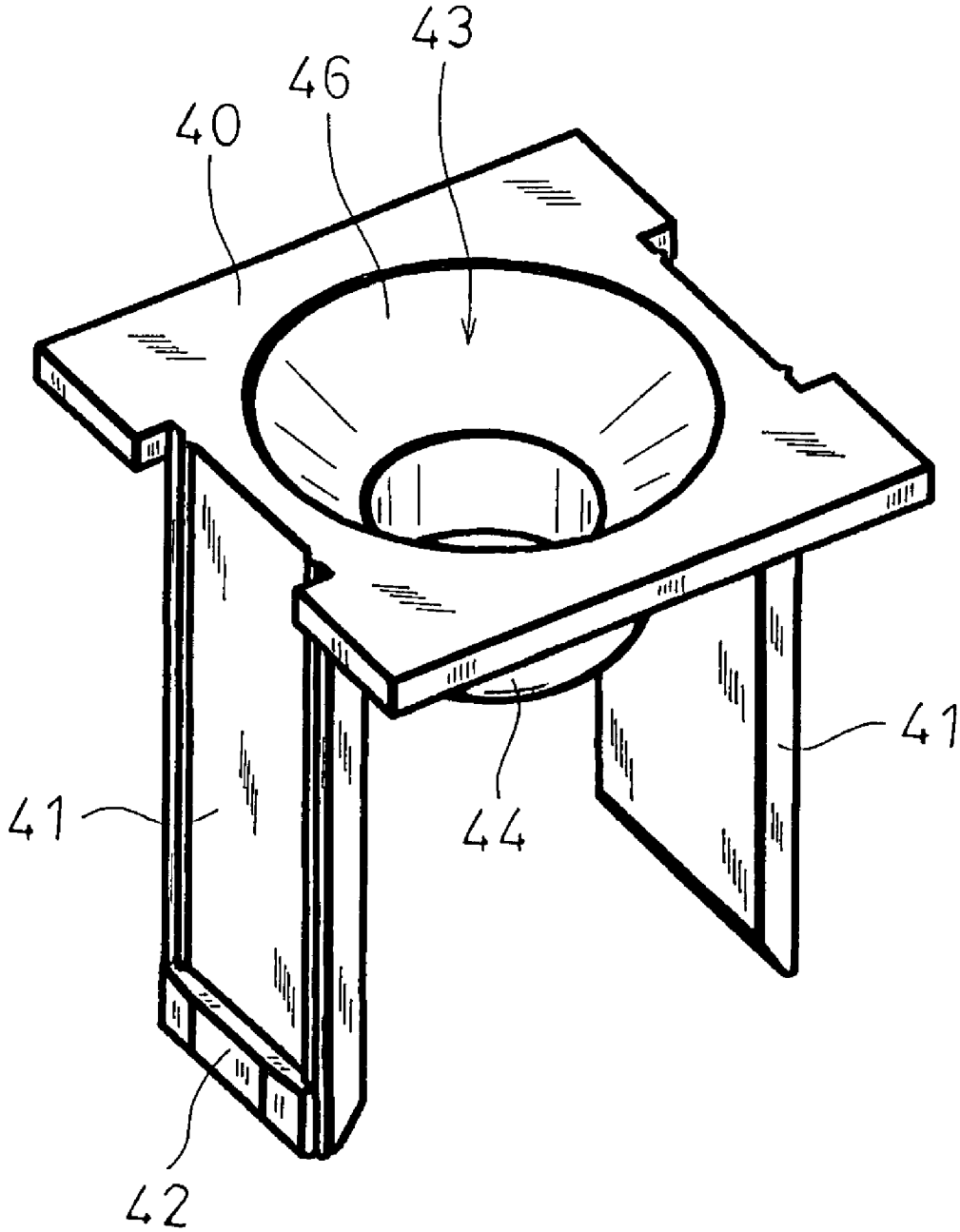
FIG. 6 is a perspective view of a keytop disposed in the push switch.
Figure 7:
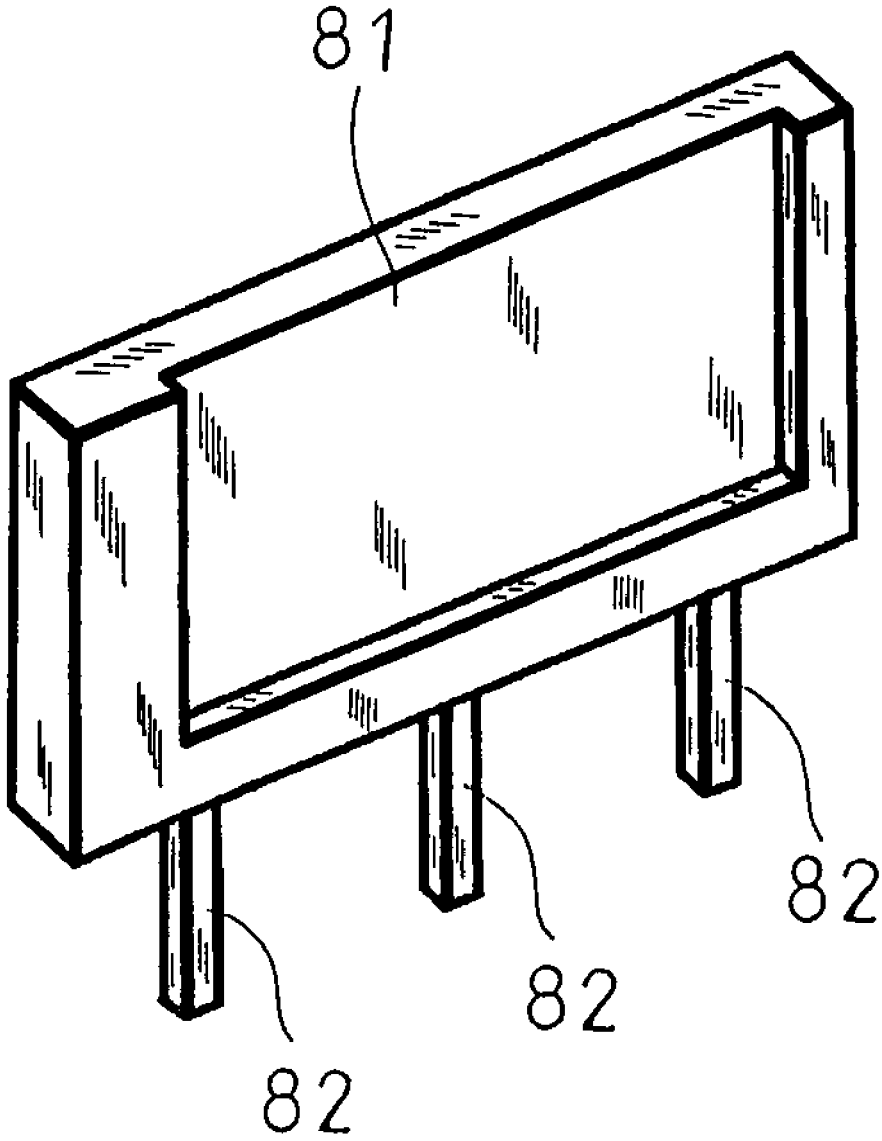
FIG. 7 is a perspective view of stationary contacts disposed in the push switch.
Figure 8:
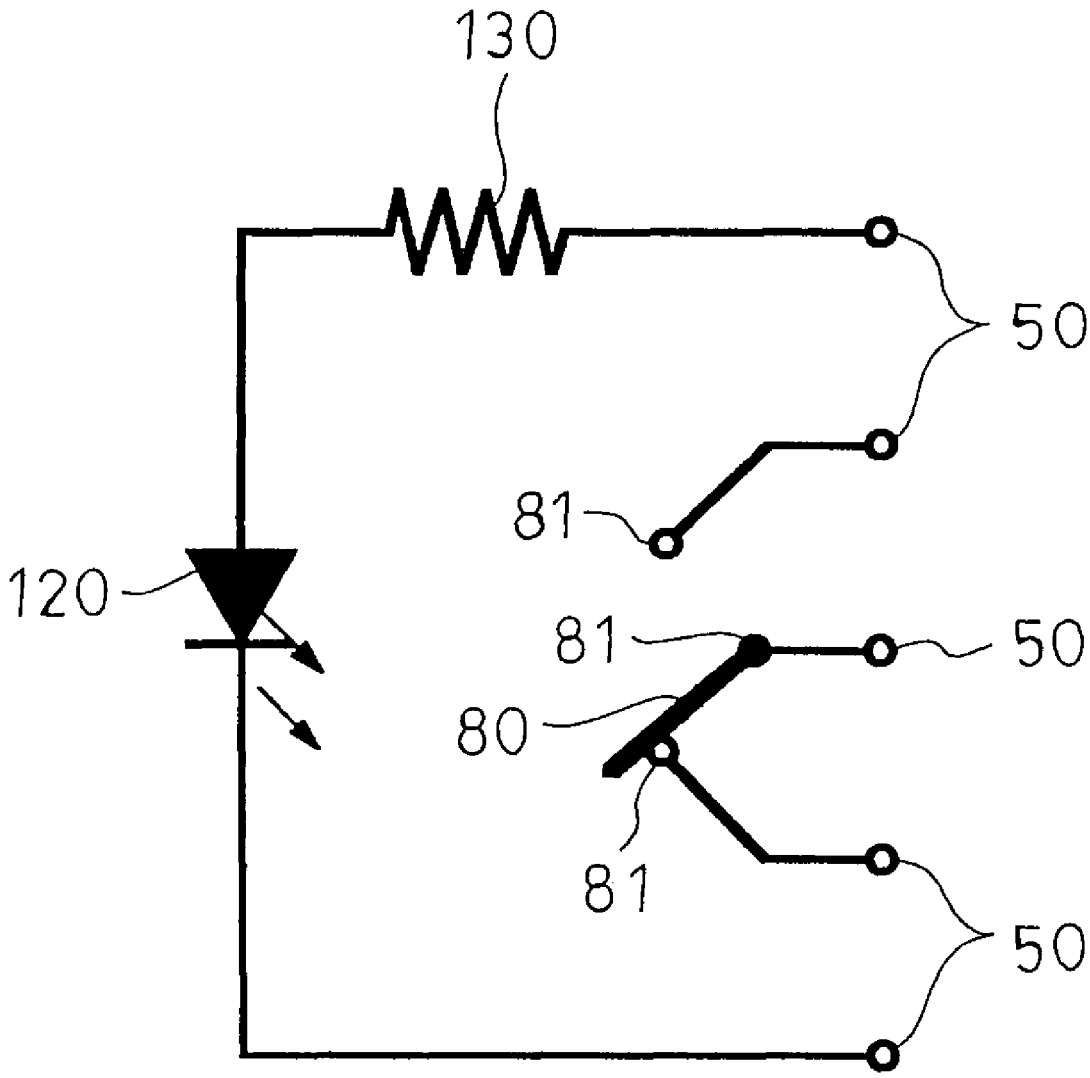
FIG. 8 is a circuit diagram of the push switch.

When the upper face of the keytop 40 is pushed by the finger in the state shown in FIGS. 1 and 2 (a first pushing operation), the keytop 40 is downward moved while the outside and middle portions of the keytop are guided by the outer face of the body 1 and that of the inner wall 23 of the double wall structure of the cover 20, and the keytop returning coil spring 110 is compressed between the top faces of the gaps 45 of the keytop 40 and the bottom face of the gap 24 of the double wall structure of the cover 20. The end portion (lower end) of the pressing portion 44 of the keytop 40 presses the end portions (upper ends) of the pressure receiving portions 31 of the slider 30. Therefore, the slider 30 is downward moved while the outer face of the slider is guided by the inner face of the body 1, and the slider returning coil spring 100 is compressed between the top face of the recess 32 in the lower face of the slider 30 and the inner bottom face of the body 1. The movable contacts 80 are contacted with the middle stationary contact and the second switchover stationary contact, and the terminals 50 which are connected respectively to the stationary contacts are electrically connected to each other, thereby performing the switching of the circuit.

In accordance with the downward movement of the slider 30, the upper end of the hook pin 61 is slid in the cam groove 60 of the slider 30 to be moved to a predetermined lock position, and the lower face of the slider 30 butts against the inner bottom face of the body 1, thereby attaining a state where the slider 30 is pressed down to the limit.

When the finger is released from the upper face of the keytop 40, the top faces of the gaps 45 are pressed by the keytop returning coil spring 110, and the keytop 40 is returned to the position attained before the pressing operation. By the upper end of the hook pin 61 which is moved to the predetermined position in the cam groove 60, the slider 30 is locked to a predetermined position (at which the slider is slightly returned from the state where the slider is pressed down to the limit), and stopped against the elastic restoring force of the slider returning coil spring 100. The end portion of the pressing portion 44 of the keytop 40 is separated from the end portions of the pressure receiving portions 31 of the slider 30, and the circuit is held to a switched state.

When the upper face of the keytop 40 is again pushed by the finger (a second pushing operation), the keytop 40 is downward moved in the same manner as the first pushing operation, and the end portion of the pressing portion 44 of the keytop 40 again presses the end portions of the pressure receiving portions 31 of the slider 30. In the same manner as the first pushing operation, therefore, the slider 30 is downward moved until the lower face butts against the inner bottom face of the body 1, and the upper end of the hook pin 61 is slid in the cam groove 60 of the slider 30 to be disengaged from the predetermined lock position.

When the finger is again released from the upper face of the keytop 40, the keytop 40 is returned to the position where the keytop is located before the pressing operation, by the elastic restoring force of the keytop returning coil spring 110 in the same manner as the first pushing operation, and also the slider 30 in which the lock is canceled is returned by the elastic restoring force of the slider returning coil spring 100 to the original position where the upper face of the slider butts against the lower face of the cover 20. The movable contacts 80 are contacted with the middle stationary contact and the first switchover stationary contact, and the terminals 50 which are connected respectively to the stationary contacts are electrically connected to each other, whereby also the circuit is returned to the original state and the state shown in FIGS. 1 and 2 is again attained.

As described above, the push switch is configured as the alternate operation type in which the contact/separation state of switch contacts is switched over each time when the keytop 40 is pushed, but the keytop is always returned to the state attained before the operation. The circuit for the LED 120 is disposed independently or irrespective of the switch circuit, and the LED is suitably caused to blink in accordance with the display object such as the operation status of the operated apparatus.

As described above, the embodiment is the push switch in which the keytop 40, the keytop returning coil spring 110 which upward urges the keytop 40, the slider 30 which is press-operated via the keytop 40, the slider returning coil spring 100 which upward urges the slider 30, and the switch contacts 80, 81 which are contacted with and separated from each other in accordance with the operating position of the slider 30 are disposed, wherein the slider returning coil spring 100 is placed at the position deviated from the axis L1 of the keytop 40. The slider 30 can be reduced in size while maintaining or expanding required distances between the slider returning coil spring 100, and the switch contacts 80, 81 and the slider locking mechanism 60, 61 in the side of the slider 30, and the like. It is not required to dispose a clearance in the height direction for avoiding interference of the slider returning coil spring 100, with the switch contacts 80, 81 and the slider locking mechanism 60, 61 in the side of the slider 30, and the like. Therefore, the switch portion can be easily miniaturized.

Moreover, in the keytop 40, the legs 41 which hang from the symmetric portions of the outer edge are disposed, and, outside the box-like body 1 which is raised from the lower side between the legs 41, the guide holes 2 into which the legs 41 are fitted to hold the keytop 40 in a vertically movable manner are disposed. The outer side portion of the keytop 40 is guided by the outside of the body 1. Even when the attached keytop 40 has a large size, therefore, the push switch in which less tilting or rattling is generated and an operation feeling is excellent can be produced.

Moreover, the through hole 43 is disposed in the middle portion of the keytop 40, the cover 20 is disposed on the upper face of the body 1, and the light source 120 with which the keytop 40 is illuminated is placed in the middle portion of the cover 20. The keytop 40 can be configured as the illumination type. As the light source, an incandescent lamp or a neon lamp may be used. However, an LED (Light Emitting Diode) is preferably used in the viewpoints of low power consumption and long life period. In this case, when the LED is a small one in which a current-limiting resistor is not incorporated, the voltage is lowered by an external resistor.

Moreover, the double wall structure configured by the inner wall 23, the gap 24, and the outer wall 25 is raised from the upper face of the cover 20, the light source 120 is housed inside the inner wall 23 of the double wall structure, and the keytop 40 is fitted in a vertically movable manner onto the outside of the inner wall 23 of the double wall structure through the through hole 43. The inner wall 23 of the double wall structure guides the middle portion of the keytop 40. While a space for housing the light source 120 is formed, therefore, tilting or rattling of the keytop 40 can be suppressed, and an operation feeling can be improved.

Moreover, in the cover 20, the plural through holes 28 are disposed in the bottom face of the gap 24 of the double wall structure, the plural pressure receiving portions 31 are raised from the upper face of the slider 30, the pressure receiving portions 31 of the slider 30 are protruded into the gap 24 of the double wall structure through the through holes 28 of the cover 20, the pressing portion 44 which hangs from the peripheral edge of the through hole 43 of the keytop, and which is fitted in a vertically movable manner onto the outside of the inner wall 23 of the double wall structure is disposed in the keytop 40, and the end portion of the pressing portion 44 of the keytop 40 butts against the end portions of the pressure receiving portions 31 of the slider 30, thereby pressing plural places of the slider 30 through the keytop 40. Therefore, the slider 30 which is upward urged by the slider returning coil spring 100 that is placed at the position which is deviated from the axis L1 of the keytop 40 is allowed to operate without producing tilting or rattling, and the operation feeling is not impaired. Since the inner wall 23 of the double wall structure guides the middle portion of the keytop 40 through the pressing portion 44, tilting or rattling of the keytop 40 can be suppressed, and an operation feeling can be improved. The inner wall 23 of the double wall structure, and the pressing portion 44 form a light blocking plate to prevent light from leaking. Therefore, the keytop 40 can be efficiently illuminated.

Moreover, in the tip end portions of the legs 41 of the keytop 40, the engaging claws 42 which are caused to be engaged with the body 1 by the returning operation of the keytop 40 are disposed, and the keytop returning coil spring 110 is placed in a preloaded state between the top faces of the gaps 45 between the pressing portion 44 of the keytop 40 and the legs 41, and the bottom face of the gap 24 of the double wall structure of the cover 20. The keytop returning coil spring 110 can be compressed and expanded without producing tilting or rattling, and the operation feeling is not impaired.

Moreover, in the slider 30, the upper face from which the pressure receiving portions 31 are protruded is caused to butt against the lower face of the cover 20 by the returning operation of the slider 30, the recess 32 is disposed in the lower face of the slider 30 at the position which is deviated from the axis L1 of the keytop 40, and the slider returning coil spring 100 is placed in a preloaded state between the top face of the recess 32 of the slider 30 and the inner bottom face of the body 1. The slider returning coil spring can be compressed and expanded without producing tilting or rattling, and the operation feeling is not impaired.

According to the embodiment, therefore, it is possible to provide a push switch which is small in size, which less produces tilting or rattling even when the attached keytop 40 has a large size, and which generates an excellent operation feeling.

In the embodiment, the LED 120 which emits one color is used as the illumination light source for the keytop 40. Alternatively, the number of the terminals 50 of the body 1 may be increased, and an LED which can emit multiple colors may be used. The slider locking mechanism of the heart-shaped cam type is used as the operating mechanism for causing the push switch to perform the alternate operation (or the push-on/push-off operation). Alternatively, an operating mechanism of the rotating cam type, or the like may be used. Although a preferred embodiment of the invention has been shown, the invention is not restricted to it, and may be variously modified without departing its spirit.

What is claimed is:

1. A push switch including a keytop;

a keytop returning coil spring which urges said keytop upwardly, a slider which is press-operated via said keytop;

a slider returning coil spring which urges said slider upwardly; and switch contacts which are contacted with and are separated from each other in accordance with an operating position of said slider, wherein:

said slider returning coil spring is placed at a position deviated from an axis of said keytop;

in said keytop, legs which hang from symmetric portions of an outer edge are disposed; and, outside a box-like body which is raised from a lower side between said legs, guide holes into which said legs are fitted to hold said keytop in a vertically movable manner are disposed.

2. A push switch according to claim 1, wherein:

a through hole is disposed in a middle portion of said keytop;

a cover is disposed on an upper face of said body; and a light source with which said keytop is illuminated is placed in a middle portion of said cover.

3. A push switch according to claim 2, wherein:

a double wall structure configured by an inner wall, a gap, and an outer wall is raised from an upper face of said cover, said light source is housed inside said inner wall of said double wall structure, and said keytop is fitted in a vertically movable manner onto an outside of said inner wall of said double wall structure through said through hole.

4. A push switch according to claim 3, wherein:

in said cover, plural through holes are disposed in a bottom face of a gap of said double wall structure, plural pressure receiving portions are raised from an upper face of said slider, said pressure receiving portions of said slider are protruded into said gap of said double wall structure through said through holes of said cover, a pressing portion which hangs from a peripheral edge of said through hole of said keytop, and which is fitted in a vertically movable manner onto the outside of said inner wall of said double wall structure is disposed in said keytop, and an end portion of said pressing portion of said keytop butts against end portions of said pressure receiving portions of said slider.

5. A push switch according to claim 4, wherein in tip end portions of said legs of said keytop, engaging claws which are caused to be engaged with said body by a returning operation of said keytop are disposed, and a keytop returning coil spring is placed in a preloaded state between top faces of gaps between said pressing portion of said keytop and said legs; and said bottom face of said gap of said double wall structure of said cover.

6. A push switch according to claim 5, wherein in said slider, an upper face from which said pressure receiving portions are protruded is caused to butt against a lower face of said cover by a returning operation of said slider;

a recess is disposed in the lower face of said slider at a position which is deviated from the axis of said keytop; and said slider returning coil spring is placed in a preloaded state between a top face of said recess of said slider and an inner bottom face of said body.

7. A push switch according to claim 1, wherein:

a cover is disposed on an upper face of said keytop;

in said slider, an upper face from which said pressure receiving portions are protruded is caused to butt against a lower face of said cover by a returning operation of said slider;

a recess is disposed in the lower face of said slider at a position which is deviated from the axis of said keytop; and said slider returning coil spring is placed in a preloaded state between a top face of said recess of said slider and an inner bottom face of said body.

* * * * *